US010340611B2

(12) United States Patent
Burrow et al.

(10) Patent No.: US 10,340,611 B2
(45) Date of Patent: Jul. 2, 2019

(54) ELECTRICAL CONNECTION AND TERMINATION ASSEMBLIES

(71) Applicants: Christopher Burrow, Ulverston (GB); Mark Simmonds, Ulverston (GB)

(72) Inventors: Christopher Burrow, Ulverston (GB); Mark Simmonds, Ulverston (GB)

(73) Assignee: Siemens Aktiengesellschaft, München (DE)

( * ) Notice: Subject to any disclaimer, the term of this patent is extended or adjusted under 35 U.S.C. 154(b) by 203 days.

(21) Appl. No.: 14/201,109

(22) Filed: Mar. 7, 2014

(65) Prior Publication Data

US 2014/0262496 A1 Sep. 18, 2014

(30) Foreign Application Priority Data

Mar. 14, 2013 (EP) ..... 13159218

(51) Int. Cl.

| | |
|---|---|
| ***H01R 4/20*** | (2006.01) |
| ***H01R 13/04*** | (2006.01) |
| ***H01R 13/20*** | (2006.01) |
| ***H01R 13/627*** | (2006.01) |
| ***H01R 13/639*** | (2006.01) |
| *H01R 13/15* | (2006.01) |
| *H01R 13/625* | (2006.01) |

(Continued)

(52) U.S. Cl.

CPC ..... *H01R 4/20* (2013.01); *H01R 4/206* (2013.01); *H01R 13/04* (2013.01); *H01R 13/20* (2013.01); *H01R 13/6276* (2013.01); *H01R 13/639* (2013.01); *H01R 4/5058* (2013.01); *H01R 13/15* (2013.01); *H01R 13/521* (2013.01); *H01R 13/523* (2013.01); *H01R 13/5205* (2013.01); *H01R 13/5216* (2013.01); *H01R 13/622* (2013.01); *H01R 13/625* (2013.01)

(58) Field of Classification Search

CPC ..... H01R 4/20; H01R 13/622; H01R 13/625; H01R 13/639; H01R 13/521; H01R 13/5202; H01R 13/5216; H01R 13/15; H01R 13/6276; H01R 13/523; H01R 13/5205; H01R 4/206; H01R 13/04; H01R 13/20; H01R 13/5058

USPC ..... 174/74 R; 439/316–318, 346–349

See application file for complete search history.

(56) References Cited

U.S. PATENT DOCUMENTS 3,817,560 A * 6/1974 Guertin ..... F16L 37/23 285/277

3,842,497 A * 10/1974 Kehl ..... H01R 4/20 29/862

(Continued)

OTHER PUBLICATIONS

European Search Report in European Patent Application No. EP 13 159 218.0, dated Aug. 12, 2013, 7 pages.

*Primary Examiner* — Steven T Sawyer
*Assistant Examiner* — Paresh H Paghadal
(74) *Attorney, Agent, or Firm* — Lempia Summerfield Katz LLC

(57) ABSTRACT

An electrical cable termination assembly includes a crimp body configured for electrically connecting a conductive core of an electrical cable to a conductive pin. The crimp body is further configured to receive the conductive core at a first end thereof and the conductive pin at a second end thereof. The assembly further includes a locking sleeve that is located radially outwardly of the crimp body and is movable relative to the crimp body between a locking position and an unlocking position.

20 Claims, 3 Drawing Sheets

(51) Int. Cl.

| | |
|---|---|
| *H01R 13/52* | (2006.01) |
| *H01R 13/622* | (2006.01) |
| *H01R 4/50* | (2006.01) |
| *H01R 13/523* | (2006.01) |

(56) References Cited

U.S. PATENT DOCUMENTS 3,964,771 A * 6/1976 Baudouin ..... F16B 21/165 285/315
4,198,080 A * 4/1980 Carpenter ..... A61M 39/1011 24/635
4,488,139 A * 12/1984 Snider, Jr. ..... H01R 13/6581 439/23
4,824,386 A * 4/1989 Souders ..... H01R 13/625 439/133
5,707,250 A * 1/1998 Smithson ..... H01R 13/6276 439/348
5,775,934 A * 7/1998 McCarthy ..... H01R 4/5033 439/427
6,190,180 B1 * 2/2001 Purington ..... H01R 13/6276 439/17
6,752,433 B2 * 6/2004 Frost ..... F16L 19/0231 285/354
6,769,926 B1 8/2004 Montena
7,331,813 B2 * 2/2008 Tsujita ..... F16B 21/165 439/348
2002/0050385 A1 * 5/2002 Murakami ..... H01R 4/206 174/74 R
2003/0082942 A1 * 5/2003 Wlos ..... H01R 13/6276 439/348
2007/0049085 A1 * 3/2007 Stagi ..... H01B 7/285 439/199
2011/0312199 A1 * 12/2011 Alrutz ..... H01R 13/622 439/188
2013/0036994 A1 * 2/2013 Abell ..... B25F 1/02 123/185.2
2014/0141658 A1 * 5/2014 Bazenas ..... H01R 13/111 439/730
2014/0300154 A1 * 10/2014 Pfister ..... B60R 22/32 297/250.1

* cited by examiner

ELECTRICAL CONNECTION AND TERMINATION ASSEMBLIES

RELATED APPLICATIONS

This application claims the benefit of European Patent Application No. EP 13159218.0, filed Mar. 14, 2013, and U.S. Provisional Patent Application No. 61/782,360, filed Mar. 14, 2013, the entire contents of both which are hereby incorporated herein by reference.

TECHNICAL FIELD

The present teachings relate generally to electrical cable termination assemblies (e.g., for underwater cables).

BACKGROUND

Electrical cable termination assemblies have been used in the offshore oil and gas industry for many years.

The conductive core of an electrical cable may be connected to a conductive pin by a termination assembly that includes a cable crimp. The cable crimp is a single-piece component that includes a first bore at one end for receiving the conductive core of the cable, and a second bore at the opposite end for receiving the conductive pin. The second bore for receiving the pin is formed by four axially extending resilient fingers. Each of the four axially extending resilient fingers has a barb at the end for engaging a recess in a pin to be received in the second bore.

To connect a conductive cable core to a conductive pin using the cable crimp, the conductive core is inserted into the first bore and the cable crimp is crimped around the conductive core, thereby locking the conductive core in the crimp. The pin is inserted into the second bore by splaying apart the fingers and pushing the pin in an axial direction into the second bore until the barbs on the end of the fingers engage with an external circumferential recess on the pin. A polyether ether ketone (PEEK) tube is positioned radially outwardly of and around the resilient fingers. The tube is configured to hold the fingers around the pin, such that an electrical connection is established between the cable crimp and the pin.

An insulating termination sleeve is provided radially outwardly of the cable crimp and the PEEK tube. The insulating termination sleeve extends axially over part of the cable insulation, the cable crimp and PEEK tube, and part of an insulation portion provided on the pin.

SUMMARY AND DESCRIPTION

The scope of the present invention is defined solely by the appended claims, and is not affected to any degree by the statements within this summary.

The present embodiments may obviate one or more of the drawbacks or limitations in the related art. For example, in some embodiments, a cable termination assembly with an improved cable crimp design is provided.

In a first aspect, an electrical cable termination assembly is provided that includes a crimp body configured for electrically connecting a conductive core of an electrical cable to a conductive pin. The crimp body is further configured to receive the conductive cable core at a first end thereof and the conductive pin at a second end thereof. The electrical cable termination assembly further includes a locking sleeve and a locking member. The locking sleeve is located radially outwardly of the crimp body, and is movable relative to the crimp body between a locking position and an unlocking position. The locking member is movable relative to the crimp body so as to be able to lock the pin in the crimp body when the locking sleeve is moved from the unlocking position to the locking position.

With this arrangement, the pin may be received in a complete bore (e.g., a bore that is not formed of fingers or segments but that is continuous in the circumferential direction) in the crimp body while still being able to lock the pin in the bore. By providing a locking member that may move relative to the crimp body to lock the pin in the crimp body, an improved and more reliable electrical connection may be obtained between the pin and the crimp body.

To provide a good electrical connection between the crimp body and the pin a highly toleranced bore that receives the pin is provided. In the conventional configuration described above, the fingers are splayed to allow insertion of the pin to be inserted. This splaying may result in plastic deformation that will affect the shape of the bore since the barbs that lock the pin in position are part of the crimp body and thus may not move relative to the crimp body. With a configuration in accordance with the first aspect, the part that receives the pin may not be deformed by insertion of the pin, such that a more reliable electrical connection may be provided between the pin and the crimp body.

When the locking sleeve is in the locking position, the pin is prevented from coming out of the bore. The pin may be fixed relative to the crimp body. Alternatively, when locked in the bore, the pin may move in an axial direction relative to the crimp body without being pulled completely out of the bore.

In some embodiments, a conductive contact cage is provided in the part of the crimp body that receives the pin (e.g., a bore). The contact cage may provide a tight fit and hence a reliable electrical current flow path between the pin and the crimp body. The contact cage may have a certain resilience to provide the fit. The contact cage may be cylindrical with axially extending slots. A suitable contact cage is a MULTILAM™.

The assembly may include an insulating termination sleeve. When the parts are assembled, the insulating termination sleeve is provided radially outwardly of the crimp body and locking sleeve. The insulating termination sleeve extends in an axial direction from the insulation of the cable, over the crimp body and locking sleeve, to over the insulation of the pin. The insulating termination sleeve provides insulation around the electrical connection to electrically isolate the connection and prevent and/or reduce leakage to earth. In some embodiments, the termination sleeve is made of silicone. Silicone provides good insulating properties while being flexible to facilitate assembly of the termination.

In some embodiments, the locking sleeve is configured to extend over substantially the entire axial distance between the insulator of the electrical cable and an insulator around the conductive pin. For example, the locking sleeve is configured to cover the crimp body between the insulating parts.

Covering the crimp body between the insulating parts protects the components that extend radially outwardly of the locking sleeve from the crimp body. The crimp body may be rough and sharp and have sharp edges (e.g., where the crimp body is crimped to the conductive cable core). By providing a locking sleeve, the components that lie radially outwardly of the sleeve may be protected. For example, if a silicone termination sleeve is provided, sharp edges of the cable crimp may tear or rip the termination sleeve, thereby degrading the insulating effect of the termination sleeve and reducing the lifetime of the connection. In some embodiments, the crimp body is formed of copper. A copper crimp body may have a high conductivity to provide a good electrical connection between the conductive cable core and the pin.

In some embodiments, the locking sleeve is also made of a conductive material (e.g., copper), such that the locking sleeve may cloak the crimp body from an electric field gradient. Due to the uneven and rough surface of the crimp body (e.g., where the crimp body is crimped to the cable body), air pockets may form around the crimp body. However, when a conductive locking sleeve is provided that extends over these air pockets, there is no electrical field gradient across the air pocket, such that arcing and breakdown does not occur. In some embodiments, the locking sleeve may have a smooth outer profile to provide good contact with the insulator around the connection (e.g., a termination sleeve) by minimizing air gaps outside the locking sleeve. In addition, the smooth profile may avoid step changes in the electrical field. At lower voltages (e.g., 5 kV), small air pockets in an electric field gradient are tolerable. However, as the voltage increases (e.g., to 8 kV or more), these air pockets are exposed to higher electric field gradients that may cause problems (e.g., arcing) that may substantially reduce the lifetime of the termination.

The assembly may be used at root mean square voltages equal to or greater than 5 kV or 8 kV.

In some embodiments, the locking sleeve is configured such that rotation of the locking sleeve moves the locking sleeve relative to the crimp body between the locking position and the unlocking position.

The cable to pin connection may be formed with less force than conventional arrangements. In some embodiments, the pin may be inserted into the bore that receives the pin with minimal force. The pin may be locked in place by application of a torque that causes rotation of the locking sleeve relative to the crimp body. This configuration contrasts with other arrangements wherein the pin is forced into the bore with a significant amount of axial force.

When the locking sleeve is configured such that rotation of the locking sleeve moves the locking sleeve between the locking position and the unlocking position, the locking sleeve may be threadedly engaged with the crimp body. In such a configuration, rotation of the locking sleeve causes the locking sleeve to move axially between the locking position and the unlocking position.

Due to the threaded engagement, the axial position of the locking sleeve relative to the crimp body may be fixed unless the locking sleeve is rotated. Once the assembly is assembled, there is a reduced chance of the locking sleeve being moved since application of an axial force does not move the locking sleeve. Therefore, once fully assembled and deployed, the locking sleeve is fixed in position, such that the reliability of the connector is improved. With the locking sleeve in the locking position, the locking sleeve may be secured in place with an adhesive, such as LOCTITE™.

In some embodiments, the locking sleeve includes a recess and the locking member is at least partially located in the recess when the locking sleeve is in the unlocking position. When the locking sleeve includes a recess and the locking member is at least partially located in the recess when the locking sleeve is in the unlocking position, the locking sleeve and the locking member may be configured such that the locking member is moved out of the recess when the locking sleeve is moved from the unlocking position to the locking position.

In some embodiments, the locking member is at least partially disposed in an aperture in the crimp body. The aperture may extend radially through a wall of the crimp body.

A simple mechanism with minimal parts that may securely lock the pin in the crimp body may be provided as described herein.

In some embodiments, once the pin is locked in the crimp body (e.g., when the locking sleeve is in the locking position), the pin and the locking member are movable in an axial direction relative to the crimp body between a retracted position and an extended position. For example, the aperture may have a dimension (e.g., a length) in the axial direction (e.g., the longitudinal direction) of the crimp body that is greater than a dimension (e.g., a width) in the axial direction of the portion of the locking member that is located in the aperture.

When the aperture has a dimension in the axial direction of the crimp body that is greater than a dimension in the axial direction of the portion of the locking member that is located in the aperture, the locking member may move in an axial direction in the aperture when the locking member is engaged with the pin. As a result, the pin and the locking member may move in an axial direction relative to the crimp body and the locking sleeve. In other words, the crimp body may float axially on the pin. For example, the aperture may be 3 mm longer in the axial direction than the width of the locking member disposed in the aperture. In such an example, the pin may move relative to the crimp body by up to 3 mm.

When the assembly is in the retracted position, insulation on the pin may abut against an end of the crimp body and/or the locking sleeve. When the assembly is in the extended position, there may be a gap between the insulation on the pin and the end of the crimp body and/or the locking sleeve. A part of the pin that is not provided with an insulating portion may extend the gap formed in the extended position.

A configuration wherein the crimp body may move axially on the pin may be provided when the cable that the pin is locked to has a short length (e.g., less than 400 mm). When a cable has a short length, the cable is unable to buckle axially (e.g., into a helical or wave like form) to accommodate a substantial change in length. In such circumstances, the connection between the pin and the cable may accommodate length changes. Such a configuration may also be used with longer cables that are unable to accommodate length changes (e.g., cables that may not bend).

When the assembly includes a conductive contact cage, the conductive cage may move with the pin. If the pin is moved relative to the crimp body, the conductive contact cage also moves relative to the crimp body but not relative to the pin or the locking member.

When the pin and the locking member are movable in an axial direction relative to the crimp body, the termination assembly may include a compensation insert. The compensation insert may be configured to prevent gaps from developing underneath the termination sleeve between the insulation on the pin and an end of the crimp body when the assembly is moved from the retracted position to the extended position.

In some embodiments, the compensation insert is an annular member. For example, the compensation insert may be an annular member with a constant outer diameter and a gradually increasing inner diameter (e.g., such that the annular member forms a sharp edged doughnut).

In some embodiments, when the assembly is in the retracted position, the compensation insert is configured to be located radially outwardly of the locking sleeve and the crimp body. The compensation insert is further configured to extend over a portion of the crimp body and the locking sleeve, and to abut at one end the insulation provided on the pin. In some embodiments, when the assembly is in the extended position, the compensation insert is configured to be located radially outwardly of the pin, the locking sleeve, and the crimp body. The compensation insert is further configured to extend over the exposed portion of the pin, the crimp body, and the locking sleeve, and to abut at one end the insulation provided on the pin.

In some embodiments, the compensation insert and the termination sleeve are energized against the pin cable crimp, the locking sleeve, and the cable assembly. In such embodiments, there are substantially no gaps regardless of whether the termination sleeve is in an extended position, a retracted position, or an intermediate position.

In some embodiments, the locking member is moved in a radially inward direction when the locking sleeve is moved from the unlocking position to the locking position. The locking member may engage with a pin that is received in the crimp body, thereby locking the pin in the crimp body.

In some embodiments, the locking member includes at least one ball (e.g., a ball bearing). In some embodiments, a plurality of locking members is provided (e.g., three balls). The plurality of locking members may be located circumferentially around the crimp body. The pin may be locked in position by the plurality of locking members spaced circumferentially around the pin. An effective and reliable locking of the pin in the crimp body may be provided.

An electrical cable termination in accordance with the present teachings is also provided. The electrical cable termination includes a cable termination assembly of a type described above in relation to the first aspect of the present teachings; an electrical cable with a conductive core; and a conductive pin. The conductive core of the electrical cable is crimped in the crimp body at the first end thereof. The conductive pin is received in the crimp body at the second end thereof. The pin is configured to be locked in the crimp body when the locking sleeve is in the locking position to provide an outer termination wherein an improved and more reliable electrical connection may be obtained between a pin and a conductive core of a cable.

In some embodiments, the pin includes a circumferential groove and the locking member is configured to engage with the groove on the pin when the locking sleeve is in the locking position. A secure engagement may be achieved between the pin and the locking member without having to damage the pin.

When the pin is received in the crimp body, an electrical contact is provided between the pin and the crimp body. The pin may extend forwardly into the second end of the crimp body. In some embodiments, the electrical contact is axially behind the groove in the pin. Thus, the electrical contact may be nearer the second end of the crimp body as compared to the groove.

A reduction in the cross-sectional area of the pin caused by the groove may be achieved forwardly of the electrical contact with respect to the pin. An electrical current-carrying path may extend forwardly along the pin via the electrical contact path between the pin and the crimp body that is behind the groove in the pin. The electrical contact path may then extend along the crimp body towards the conductive core of the cable, thereby improving the electrical properties of the connection. Due to a reduction in the amount of resistive heating that may occur, the lifetime of the termination may increase. In addition, the pin is mechanically resistant since the groove is near the end of the pin.

A method of terminating a cable in accordance with the present teachings includes terminating an electrical cable with an assembly of a type described above to form an electrical cable termination of a type described above.

In some embodiments, the method includes crimping the crimp body onto the conductive core of the electrical cable. The crimping locks the conductive core in the crimp body and provides a good electrical connection therebetween.

In some embodiments, the method includes inserting a conductive pin into the crimp body and moving the locking sleeve from the unlocking position to the locking position, thereby locking the pin in the crimp body.

In some embodiments, the electrical cable termination assembly is an underwater electrical cable termination assembly. In some embodiments, the electrical cable termination is an underwater electrical cable termination. The electrical cable termination assembly and/or the electrical cable termination may be used in underwater environments (e.g., subsea).

In a second aspect, a cable termination assembly is provided that has an improved cable crimp design configured for improved reliability.

In some embodiments, an electrical cable termination assembly for terminating an electrical cable with a conductive core and an axially extending annular insulation portion around the conductive core is provided. The assembly includes a crimp body configured to be crimped to the conductive core of the electrical cable. The crimp body has an axially extending part that is configured to extend axially forwardly along a length of the conductive core. The axially extending part is further configured to be located radially outwardly of the conductive core and radially inwardly of the annular insulation portion.

With a configuration in accordance with the second aspect, the axially extending part of the crimp body may be used to help secure the annular insulation portion. Friction between the outer surface of the axially extending part and the cable insulation may prevent the insulation from moving once the electrical cable termination is deployed.

In conventional electrical cable termination assemblies, the pin is connected to the cable core via a crimp body and the whole connection is housed in an insulating termination sleeve. The cable includes a conductive core and a silicone cable insulation. The silicone cable insulation is free to move in an axial direction on the conductive core. In extreme conditions (e.g., on the seabed), the cable insulation may move in a direction axially away from the cable termination. In some cases, the cable insulation may retract out of the insulating termination sleeve. As a result, the connection may short to earth. In accordance with the present teachings, movement of the cable insulation relative to the cable termination may be minimized.

The axially extending part of the crimp body may extend forwardly into the location that is radially outward of the conductive core and radially inward of the annular insulation portion.

In some embodiments, the crimp body has a crimp wall. The axially extending part is formed by a front wall portion of the crimp wall. The crimp wall has a wall portion axially rearwardly of the front wall that has a thickness greater than that of the front wall portion.

The front wall portion may be located between the conductive core and the insulator of the electrical cable. The thicker wall portion is thicker relative to the front wall portion (e.g., the thicker wall portion has a greater dimension in the radial direction than the front wall portion). The thicker wall portion may be located radially outwardly of the conductive core and not radially inwardly of the annular insulation portion. The thicker wall portion may be rearwardly axially adjacent to the front wall portion. In some embodiments, the end of the annular insulation portion in use is located in the region of a transition between the front wall portion and the thicker wall portion.

In some embodiments, the front wall portion may have a substantially constant diameter over its length. In other embodiments, the front wall portion may taper in the forward direction (e.g., a diameter of the front wall portion decreases in the forward direction).

In some embodiments, the crimp body including the axially extending part forms a socket configured for receiving the conductive core of the cable. The socket may be of a constant diameter. When the crimp body has a front wall portion and a thicker wall portion, the external diameter of the crimp body is not constant. In other words, the external diameter of the thicker wall portion is greater than the external diameter of the front wall portion.

In some embodiments, the axially extending part includes radial projections that are configured to contact the radially inward-facing surface of the annular insulation portion, thereby increasing friction between the axially extending part and the cable insulation. As a result, movement of the cable insulation relative to the termination may be more effectively prevented.

In some embodiments, the assembly includes an insulation fixing member configured to be located radially outwardly of the insulation portion to provide a gripping space between the crimp body and the insulation fixing member. The gripping space is configured for gripping the insulation portion of the electric cable. The insulation portion may be gripped to the crimp body to prevent the insulation from moving relative to the cable termination.

In some embodiments, the insulation fixing member includes a catch (e.g., a barb) that is configured to engage the crimp body (e.g., in a groove on the crimp body). The fixing member may be locked relative to the crimp body while gripping the cable insulation to the crimp body.

In some embodiments, the insulation fixing member is made of an insulator. For example, the insulation fixing member may be made from PEEK (e.g., an insulator that is strong, rigid, and has a high temperature rating).

When the electrical termination is subjected to high pressure (e.g., in subsea environments), the conductive cable core (e.g., a multi-stranded core) is compressed. The compression may leave a gap between the cable core and the crimp body. The gap may cause problems since parts (e.g., an insulating termination sleeve) may be forced by the high pressure into the gap. For example, forcing an insulating termination sleeve into the gap may damage or puncture the insulation of the termination, thereby reducing the lifetime of the termination. A spacer made of silicone may be provided between the end of the cable insulation and the end of the cable crimp. The silicone spacer may be sacrificially squeezed into the gap to prevent the termination insulation from being forced in. However, when the crimp body has an axially extending part that extends underneath the cable insulator, the silicone spacer may not be provided between the end of the cable insulation and the end of the cable crimp.

Accordingly, in some embodiments, the assembly includes a blocking ring configured to be located at the end of the axially extending part. The blocking ring may be located radially outwardly of the conductive core but radially inwardly of the insulation portion. The blocking ring may prevent the cable insulation from being forced into any gap that may form between the cable core and the crimp body, thereby preventing damage to the insulation.

In some embodiments, the assembly includes an O-ring located axially forwardly of the blocking ring relative to the end of the axially extending part, radially outwardly of the conductive core, and radially inwardly of the insulation portion, thereby providing a stuffing that may sacrificially fill any voids formed. In some embodiments, the crimp body is harder than the blocking ring and the blocking ring is harder than the O-ring. The hardness of the components underneath the insulation is graded. The grading may improve the sacrificial stuffing of the configuration. For example, the crimp body may be formed from copper, the blocking ring may be formed from PEEK, and the O-ring may be formed from an elastomeric material (e.g., hydrogenated nitrile butadiene rubber a.k.a. HNBR).

In some embodiments, the blocking ring is a split ring. A split ring allows for change in the circumference of the blocking ring as the core changes in diameter. As a result, damage to the insulator may be reliable prevented even during substantial changes in hydrostatic pressure (e.g., when the assembly is moved from atmospheric pressure to an underwater environment).

An electrical cable termination in accordance with the present teachings includes a cable termination assembly of a type described above in relation to the second aspect; and an electrical cable with a conductive core and an axially extending annular insulation portion around the conductive core. The axially extending part of the crimp body is located between the radial outward surface of the conductive core and engages the radial inwardly facing surface of the insulation portion.

As a result of the friction caused by the axially extending member, a termination is provided wherein movement of the insulation relative to the crimp body may be prevented or minimized.

In some embodiments, the electrical cable termination includes an insulation fixing member of a type described above. The axially extending part and the insulation fixing member may grip the annular insulation portion therebetween. The insulation may be gripped to the crimp body to prevent relative movement between the axially extending part and the insulation fixing member.

A method of terminating a cable in accordance with the present teachings includes terminating an electrical cable to an assembly of a type described above in relation to the second aspect. The electrical cable includes a conductive core and an axially extending annular insulation portion around the conductive core.

In some embodiments, the electrical cable termination assembly is an underwater electrical cable termination assembly. In some embodiments, the electrical cable termination is an underwater electrical cable termination. The electrical cable termination assembly and/or the electrical cable termination may be used in underwater environments (e.g., subsea).

In a third aspect, a cable termination assembly having improved electrical properties to increase the lifetime of the termination is provided. The electrical cable termination assembly includes a crimp body configured for electrically connecting a conductive core of an electrical cable to a conductive pin and a conductive sleeve. The crimp body is configured to receive the conductive cable core at one end thereof and the conductive pin at a second end thereof. The conductive sleeve is electrically connected to the crimp body and is located radially outwardly of the crimp body. The conductive sleeve extends over at least part of the crimp body that receives the conductive core and at least part of the crimp body that receives the conductive pin.

The conductive sleeve may cloak the crimp body from an electric field gradient. Due to the uneven and rough surface of the crimp body (e.g., where the crimp body is crimped to the cable body), air pockets may form around the crimp body. However, when a conductive sleeve is provided that extends over the air pockets, there is no electrical field gradient across the air pockets. As a result, arcing and breakdown do not occur.

At lower voltages (e.g., 5 kV), small air pockets in an electrical field gradient are tolerable. However, as voltage increases (e.g., to 8 kV), the gradient increases and the air pockets may cause problems (e.g., arcing) that may reduce the lifetime of the termination. The assembly may be used at root mean square voltages equal to or greater than 5 kV or 8 kV.

In some embodiments the sleeve is located directly radially outwardly of the crimp body.

In some embodiments, the sleeve is configured to extend over substantially the entire axial distance between an insulator of the electrical cable and an insulator around the conductive pin. An electrical cloak is formed over the entire length of the crimp body between the insulating portions. As a result, the uneven surfaces and step changes in profile may be cloaked by the conductive sleeve.

In some embodiments, the conductive sleeve has a smooth outer profile to provide good contact with the insulator around the connection (e.g., a termination sleeve) by reducing air pockets outside the conductive sleeve. In addition, the smooth profile may prevent changes in electrical field.

In some embodiments, the conductive sleeve has a radially outer surface, the crimp body has a radially outer surface, and the diameter of the radially outer surface at the end of the sleeve corresponds to the diameter of the radially outer surface of the crimp body adjacent thereto.

The external profile formed by the conductive sleeve and the crimp body between the insulating portions may be substantially continuous and may avoid step changes. The electric field gradient around the external profile of the termination may be minimized.

In some embodiments, the crimp body includes a protrusion that the conductive sleeve abuts against when the assembly is assembled. In such embodiments, the conductive sleeve is located in the correct position relative to the crimp body when the assembly is assembled.

In some embodiments, the conductive sleeve is threadedly engaged with the crimp body. In such embodiments, the conductive sleeve, once assembled, will not move relative to the crimp body due to an axial force. The reliability of the termination may thus be improved.

When the crimp body includes a protrusion, the conductive sleeve may be correctly positioned by abutting the end of the conductive sleeve against the protrusion. In some embodiments, the protrusion has the same outer diameter as the end of the conductive sleeve, such that the external profile is continuous.

In some embodiments, the conductive sleeve is made of the same material as the crimp body. For example, each of the conductive sleeve and the crimp body may be formed from copper.

An electrical cable termination in accordance with the present teachings includes an electrical cable termination assembly of a type described above in relation to the third aspect; an electrical cable with a conductive core; and a conductive pin. The crimp body electrically connects the conductive core of the electrical cable to the conductive pin. The conductive sleeve may cloak the crimp body from an electric field gradient.

In some embodiments, the conductive sleeve is the same as the locking sleeve described above. For example, one sleeve (e.g., a single sleeve) with features of both the locking sleeve and the conductive sleeve (and various embodiments thereof) may be provided. In other embodiments, a conductive sleeve may be provided in addition to a locking sleeve.

A method of terminating a cable in accordance with the present teachings includes terminating the cable with an assembly of a type described above in relation to the third aspect.

In some embodiments, the electrical cable termination assembly is an underwater electrical cable termination assembly. In some embodiments, the electrical cable termination is an underwater electrical cable termination. The electrical cable termination assembly and/or the electrical cable termination may be used in underwater environments (e.g., subsea).

It is to be understood that elements and features of the various representative embodiments—including the above-described first aspect, second aspect, and third aspect—may be combined in different ways to produce new embodiments that likewise fall within the scope of the present teachings. The assembly of the first aspect may include features of the second aspect and/or the third aspect with or without certain features of the second aspect or the third aspect. Similarly, the assembly of the second aspect may include features of the first aspect and/or the third aspect with or without certain features of the first aspect or the third aspect. Likewise, the assembly of the third aspect may include features of the first aspect and/or the second aspect with or without certain features of the first aspect or the second aspect.

An electrical cable termination assembly and an electrical cable termination as described herein may be used in underwater environments. In some embodiments, the termination is in a chamber sealed from the outside environment (e.g., to prevent ingress of water upon immersion). The chamber may provide pressure balancing with respect to the outside environment. The pressure inside the chamber may increase or decrease according to an increase or decrease in the pressure of the outside environment. The chamber may contain an insulating medium. The insulating medium may be a flexible solid (e.g., silicone rubber) or a fluid (e.g., a liquid or gel). In the case of a fluid, the chamber may have a flexible wall that allows pressure balancing between the pressure inside the chamber and the outside environment.

BRIEF DESCRIPTION OF THE DRAWINGS

Certain embodiments in accordance with the present teachings will now be described solely by way of example and with reference to the accompanying drawings, wherein like reference numerals refer to like elements.

DETAILED DESCRIPTION

Figure 1:
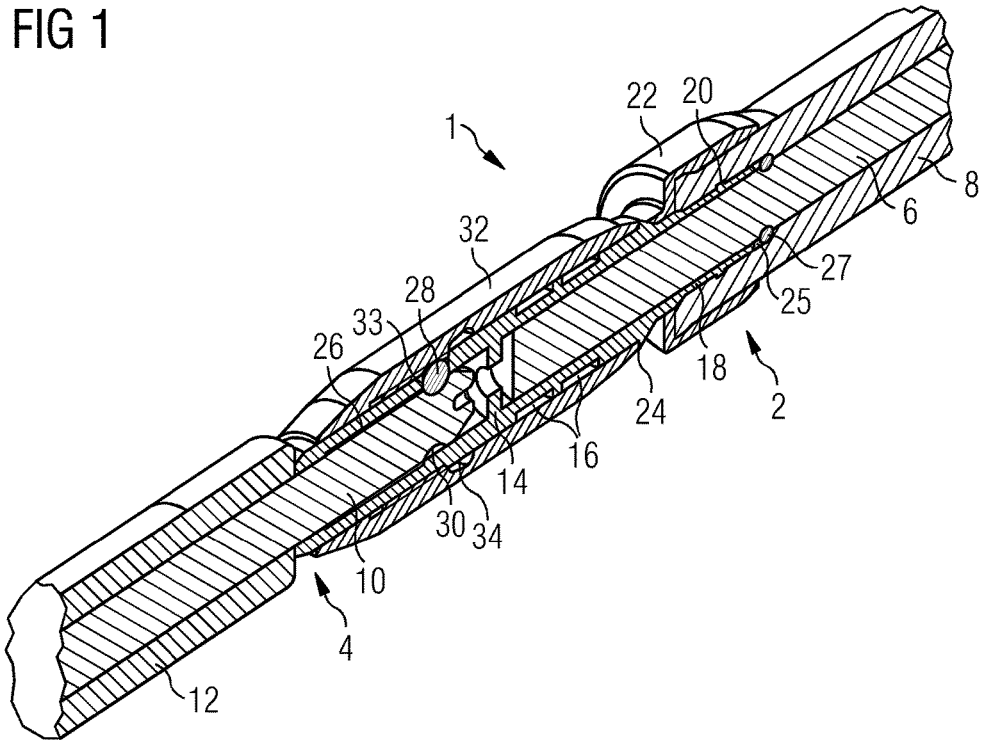
FIG. 1 is a cross-sectional perspective view of a first exemplary electrical cable termination.
Figure 2:
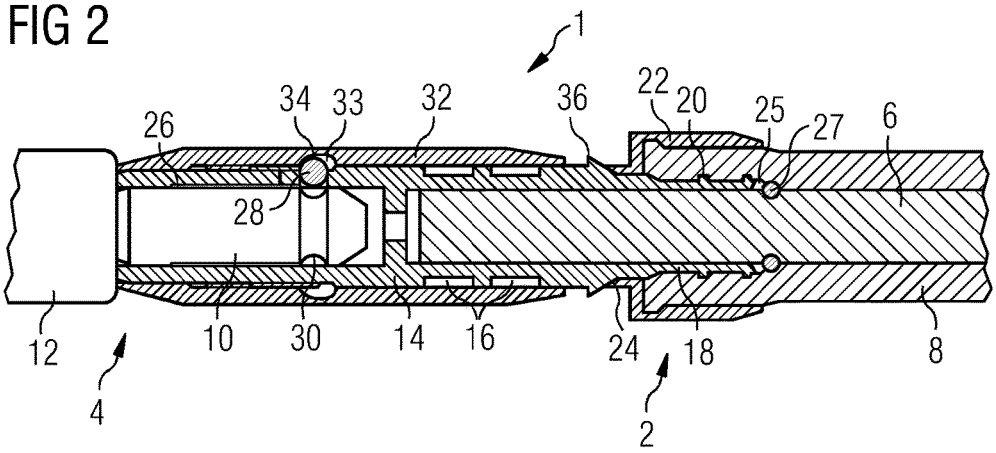
FIG. 2 is a cross-sectional view of the first exemplary electrical cable termination in an unlocked position.
Figure 3:
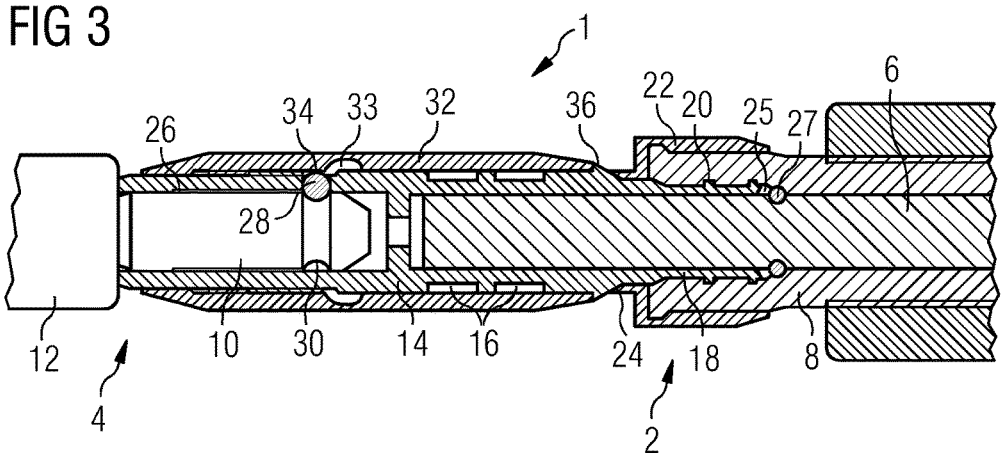
FIG. 3 is a cross-sectional view of the first exemplary electrical cable termination in a locked position.
Figure 4:
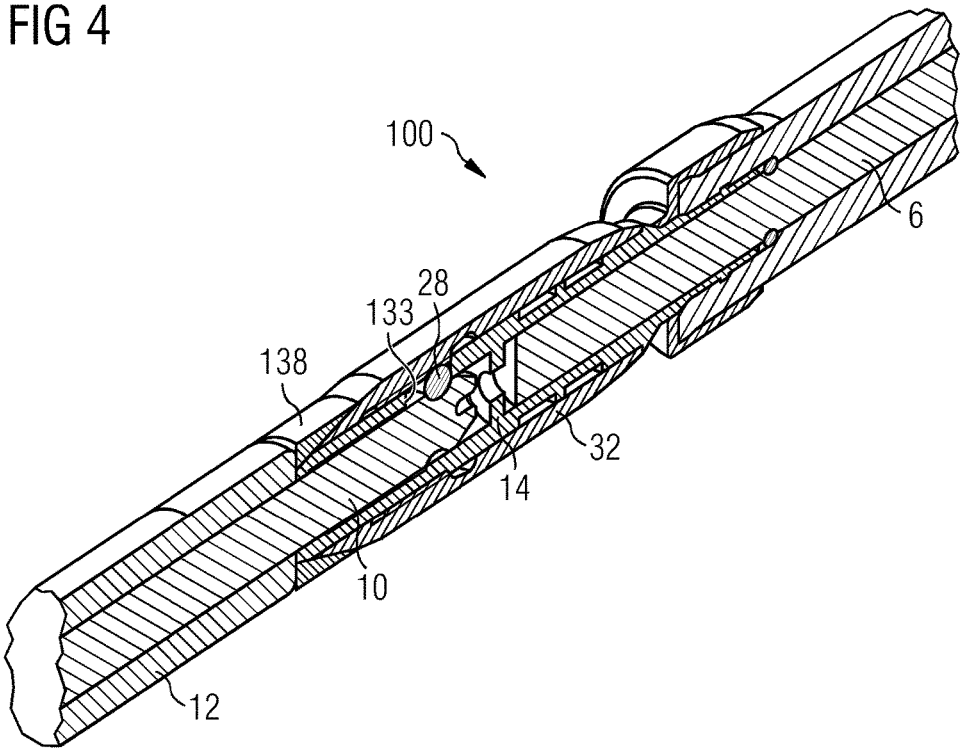
FIG. 4 is a cross-sectional perspective view of a second exemplary electrical cable termination.
Figure 5:
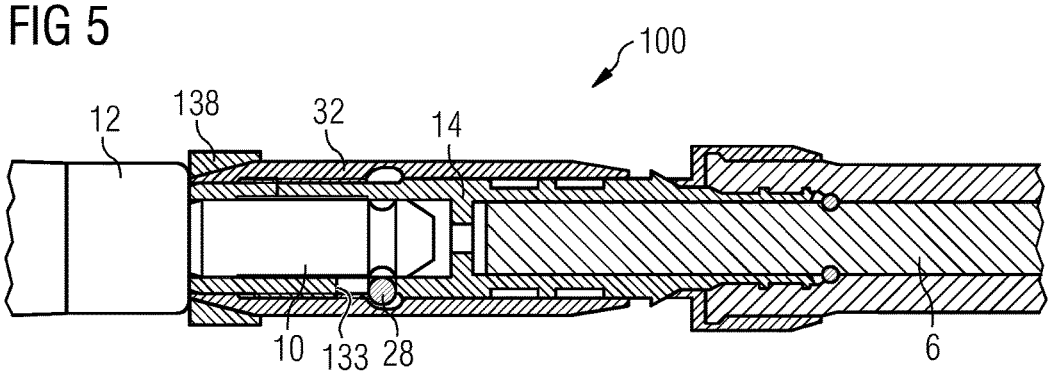
FIG. 5 is a cross-sectional view of the second exemplary electrical cable termination in an unlocked position.

FIGS. 1 to 3 show a first embodiment of a fixed crimp arrangement. As shown in FIG. 1, an electrical cable termination 1 electrically connects a cable 2 to a pin assembly 4. The cable 2 includes a stranded copper core 6 and a silicone annular insulating portion 8.

The pin assembly 4 includes a conductive pin 10 and an insulating portion 12 formed of PEEK.

The electrical cable 2 is electrically connected to the pin assembly 4 via a crimp body 14. The conductive core 6 of the cable 2 is received in a bore at one end of the crimp body 14 and is crimped therein at two crimp portions 16.

The crimp body 14 includes an axially extending part 18 that extends axially along the cable core 6. The axially extending part 18 is positioned radially outwardly of the conductive cable core 6 and radially inwardly of the insulating portion 8. The axially extending part 18 includes radial protrusions 20 that engage with the radially inner surface of the cable insulation 8 to prevent or minimize relative movement between the insulating portion 8 and the crimp body 14.

The insulating portion 8 is fixed relative to the crimp body 14 by an annular fixing member 22. The fixing member 22 extends circumferentially around the radial outer surface of the insulating portion 8. The axially extending portion 20 and the annular fixing member 22 grip the insulating portion 8 therebetween, thereby fixing the insulating portion 8 relative to the crimp body 14.

The fixing member 22 includes a barb 24 that engages with a groove in the crimp body 14, thereby locking the fixing member 22 relative to the crimp body 14.

A blocking ring 25 in the form of a PEEK split ring is located at the end of the axially extending part. The blocking ring 25 is located radially outwardly of the conductive core 6 and radially inwardly of the insulation portion 8. An HNBR O-ring 27 is provided at the opposite side of the blocking ring 25 relative to the end of the axially extending part 18.

The pin 10 is received in a bore at the end of the crimp body 14 that is opposite to the bore that receives the conductive cable core 6. The bore for receiving the pin 10 is sized so as to receive the pin 10 without deformation.

A conductive contact cage 26 is provided in the bore of the crimp body 14 that receives the pin 10. The contact cage provides a tight fit and a reliable electrical current flow path between the pin 10 and the crimp body 14. The cage is formed of a plurality of leaf springs and may have a cylindrical form with axially extending slots between the leaf springs. For example, in some embodiments, the contact cage is a MULTILAM™.

The pin 10 is locked in the crimp body 14 by a plurality of locking members 28. Each of the plurality of locking members is in the form of a ball (only one ball is visible in the FIGS.). The locking members are circumferentially spaced around the pin 10. The pin has a circumferential groove 30. The locking members 28 engage with the circumferential groove 30 when the pin 10 is in a locked position. In the locked position (e.g., as shown in FIGS. 1 and 3), the locking members 28 are held in engagement with the groove 30 of the pin 10 by a locking sleeve 32. Each of the plurality of locking members 28 extends through a corresponding aperture 33 in the crimp body 14. The process of locking the pin 10 in the crimp body is described below in reference to FIGS. 2 and 3.

The locking sleeve 32 is an annular component provided directly radially outwardly of the crimp body 14. The locking sleeve 32 extends over substantially the entire axial distance between the insulating portion 8 of the cable and the insulating portion 12 of the pin assembly. The locking sleeve 32 is threadedly engaged with the crimp body 14. Rotation of the locking sleeve 32 moves the locking sleeve 32 in an axial direction relative to the crimp body 14. The locking sleeve 32 is made of copper. The locking sleeve includes a circumferential recess 34 configured for receiving the locking members 28 when the termination is in an unlocking or an unlocked position.

The unlocked state is shown in FIG. 2. In the unlocked state, the locking sleeve 32 is in an unlocking position. In the unlocking position, the recess 34 is aligned with the apertures 33 in the crimp body 14. Each locking member 28 is located in the recess 34 and in the aperture 33. The locking member 28 does not extend into the bore in the crimp body 14. With such a configuration, the pin 10 may be freely inserted into and removed from the crimp body 14.

To move the locking sleeve 32 into the locking position, as shown in FIG. 3, the locking sleeve is rotated relative to the crimp body 14. Rotating the locking sleeve relative to the crimp body causes the locking sleeve 32 to translate in an axial direction relative to the crimp body 14. The locking sleeve 32 is translated axially until an end of the locking sleeve abuts against a protrusion 36 on the crimp body. As a result of the axial translation, the recess 34 is moved out of alignment with the apertures 33 in the crimp body. The locking members 28 in turn move through the aperture 33 in the crimp body 14 and partially extend into the bore in the crimp body 14. When the pin is inserted, the groove 30 in the pin aligns with the aperture 33 in the crimp body 14. As the locking member 28 enters into the bore in the crimp body 14, the locking member 28 extends into the groove 30 in the pin 10, thereby locking the pin 10 in the crimp body 14. The recesses 34 in the locking sleeve 32 have a sloped edge. The locking members 28 are guided along the sloped edge as the locking members 28 are moved into the locking position. As shown in FIGS. 1 to 3, the axial dimension of the aperture 33 is substantially the same as the width of the locking member 28. As a result, once the locking members 28 engage with the groove 30 on the pin 10, the pin 10 and the locking members 28 are fixed (e.g., may not move) relative to the crimp body and the locking sleeve in the axial direction. In other words, the electrical cable termination 1 provides a fixed crimp arrangement.

To go from the locking position to the unlocking position, the locking sleeve 32 is rotated in the opposite direction to the direction used for locking the device. The locking sleeve 32 is translated in the opposite axial direction and the recesses 34 are realigned with the apertures 33 in the crimp body 14. The locking members 28 may therefore move out of the bore and the groove 30, such that the pin 10 may be removed from the crimp body 14.

FIGS. 4 to 7 show a second embodiment of an electrical cable termination 100 in a sliding crimp arrangement.

Common elements in the first and second embodiments are indicated using common reference numerals. In the following description of the second embodiment, a detailed description of elements common to the first embodiment already described above has been omitted in order to avoid unnecessary repetition.

Figure 6:
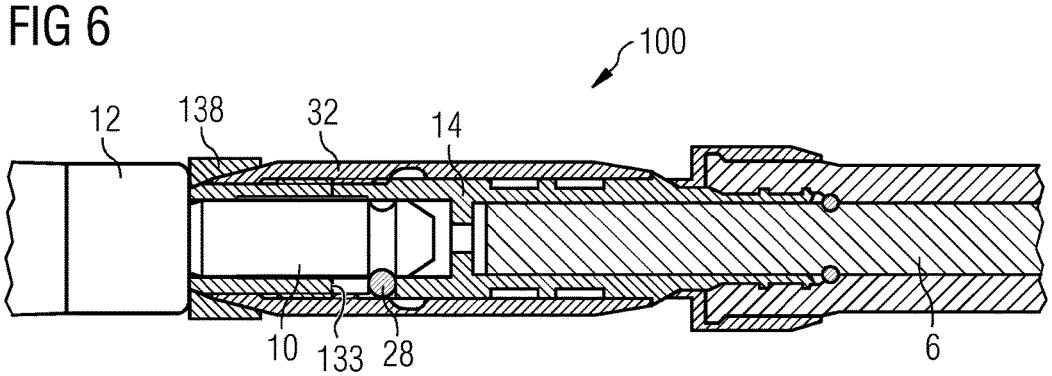
FIG. 6 is a cross-sectional view of the second exemplary electrical cable termination in a locked and retracted position.
Figure 7:
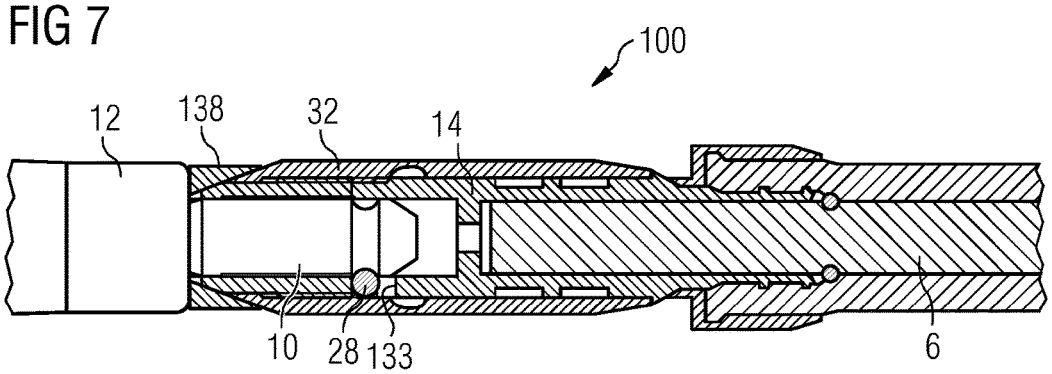
FIG. 7 is a cross-sectional view of the second exemplary electrical cable termination in a locked and extended position.

The electrical cable termination 100 of the second embodiment differs from that of the first embodiment in that the aperture 133 in the crimp body 14 has a dimension in the axial direction that is greater than the dimension in the axial direction of the portion of the locking member 28 that is located in the aperture. After the electrical cable termination 100 is put in the locking position by rotation of the locking sleeve 32, as described above, the pin 10 and the locking members 28 may be moved in the axial direction relative to the crimp body 14 and the locking sleeve 32. The pin may be moved between a retracted position, as shown in FIG. 6, and an extended position, as shown in FIG. 7. In the retracted position, the end of the pin 10 is closer to the end of the conductive core 6 than in the extended position. In the retracted position, the insulation 12 of the pin 10 abuts against the end of the crimp body 14 and the locking sleeve 32. By contrast, in the extended position, there is a gap between the insulation 12 and the end of the crimp body 14 and the locking sleeve 32 that the pin 10 extends between.

The electrical cable termination 100 further includes a compensation insert 138. As shown in FIGS. 4 to 7, the compensation insert 138 is an annular member that abuts against the end of the insulation 12 on the pin 10. The compensation insert 138 is tapered to have a substantially constant outer diameter and a gradually increasing inner diameter in an axial direction away from the insulation 12 on the pin. In other words, the compensation insert 138 has a conical internal shape and a cylindrical outer shape.

In the retracted position, as shown in FIG. 6, the compensation insert 138 abuts against the end of the insulation 12 on the pin 10 at one end and extends over a portion of the crimp body 14 and a portion of the locking sleeve 32. In the extended position, as shown in FIG. 7, the compensation insert 138 abuts against the end of the insulation 12 on the pin 10 at one end. In addition, the compensation insert 138 extends over an exposed portion of the pin 10 between the insulation and the crimp body, and over a portion of the crimp body 14 and a portion of the locking sleeve 32.

Additional embodiments in accordance with the present teachings are described below. It is to be understood that elements and features of the various representative embodiments described below may be combined in different ways to produce new embodiments that likewise fall within the scope of the present teachings.

An electrical cable termination assembly includes a crimp body configured for electrically connecting a conductive core of an electrical cable to a conductive pin; a locking sleeve that is located radially outwardly of the crimp body and is movable relative to the crimp body between a locking position and an unlocking position; and a locking member. The crimp body is configured to receive the conductive cable core at a first end thereof and the conductive pin at a second end thereof. The locking member is movable relative to the crimp body so as to be able to lock the pin in the crimp body when the locking sleeve is moved from the unlocking position to the locking position.

In some embodiments, the locking sleeve is configured such that rotation of the locking sleeve moves the locking sleeve between the locking position and the unlocking position.

In some embodiments, the locking sleeve is threadedly engaged with the crimp body, such that rotation of the locking sleeve causes the locking sleeve to move axially between the locking position and the unlocking position.

In some embodiments, the locking sleeve includes a recess and the locking member is at least partially located in the recess when the locking sleeve is in the unlocking position.

In some embodiments, the locking sleeve and the locking member are configured such that the locking member is moved out of the recess when the locking sleeve is moved from the unlocking position to the locking position.

In some embodiments, the locking member is disposed in an aperture in the crimp body.

In some embodiments, the aperture in the crimp body has a dimension in the axial direction of the assembly that is greater than a corresponding dimension of the portion of the locking member disposed in the aperture, such that when the locking sleeve is in the locking position the locking member may move in an axial direction relative to the crimp body.

In some embodiments, the assembly further includes a compensation insert configured to accommodate volume changes due to relative axial movement in the assembly.

In some embodiments, the locking member is moved in a radially inward direction when the locking sleeve is moved from the unlocking position to the locking position.

In some embodiments, the locking member includes at least one ball.

In some embodiments, the assembly is an underwater electrical cable termination assembly.

An electrical cable termination includes a cable termination assembly of a type described above; an electrical cable with a conductive core; and a conductive pin. The conductive core of the electrical cable is crimped in the crimp body at the first end thereof. The conductive pin is received in the crimp body at the second end thereof. The pin is configured to be locked in the crimp body when the locking sleeve is in the locking position.

In some embodiments, the pin includes a circumferential groove and the locking member engages with the groove on the pin when the locking sleeve is in the locking position.

In some embodiments, the pin extends forwardly into the second end of the crimp body. When the pin is received in the crimp body an electrical contact is provided between the pin and the crimp body. The electrical contact is axially behind the groove with respect to the pin.

In some embodiments, the termination is an underwater electrical cable termination.

A method of terminating a cable includes terminating an electrical cable with an assembly of a type described above.

In some embodiments, the method includes crimping the crimp body onto the conductive core of the electrical cable.

In some embodiments, the method includes inserting a conductive pin into the crimp body and moving the locking sleeve from the unlocking position to the locking position, thereby locking the pin in the crimp body.

An electrical cable termination assembly for terminating an electrical cable with a conductive core and an axially extending annular insulation portion around the conductive core includes a crimp body configured to be crimped to the conductive core of the electrical cable. The crimp body has an axially extending part that is configured to extend axially forwardly along a length of the conductive core. The axially extending part is further configured to be located radially outwardly of the conductive core and radially inwardly of the annular insulation portion.

In some embodiments, the crimp body includes a crimp wall. The axially extending part is formed by a front wall portion of the crimp wall. The crimp wall has a wall portion axially rearwardly of the front wall with a thickness that is greater than a thickness of the front wall portion.

In some embodiments, the axially extending part includes radial projections that are configured to contact the radially inner surface of the annular insulation portion.

In some embodiments, the assembly includes an insulation fixing member configured to be located radially outwardly of the insulation portion. The insulation fixing member is further configured to provide a gripping space for gripping the insulation portion between the crimp body and the insulation fixing member.

In some embodiments, the insulation fixing member includes a catch that is configured to engage the crimp body.

In some embodiments, the insulation fixing member is made of an insulator.

In some embodiments, the assembly includes a blocking ring configured to be located axially forwardly of the axially extending part, radially outwardly of the conductive core, and radially inwardly of the insulation portion.

In some embodiments, the assembly includes an O-ring configured to be located at the opposite side of the blocking ring relative to the end of the axially extending part. The O-ring is further configured to be located radially outwardly of the conductive core and radially inwardly of the insulation portion.

In some embodiments, the crimp body is harder than the blocking ring and the blocking ring is harder than the O-ring.

In some embodiments, the blocking ring is a split ring.

In some embodiments, the assembly is an underwater electrical cable termination assembly.

An electrical cable termination includes a cable termination assembly of a type described above; and an electrical cable with a conductive core and an axially extending annular insulation portion around the conductive core. The axially extending part of the crimp body is located between the radial outward surface of the conductive core and engages the radial inward surface of the insulation portion.

In some embodiments, the electrical cable termination includes the insulation fixing member. The axially extending part and the insulation fixing member grip the annular insulation portion therebetween.

In some embodiments, the termination is an underwater electrical cable termination.

In some embodiments, a method of terminating a cable includes terminating an electrical cable with a conductive core and an axially extending annular insulation portion around the conductive core to an assembly of a type described above.

An electrical cable termination assembly includes a crimp body configured for electrically connecting a conductive core of an electrical cable to a conductive pin; and a conductive sleeve that is electrically connected to the crimp body. The crimp body is configured to receive the conductive cable core at one end thereof and the conductive pin at a second end thereof. The conductive sleeve is located radially outwardly of the crimp body and extends over at least part of the crimp body that receives the conductive core and at least part of the crimp body that receives the conductive pin.

In some embodiments, the sleeve is located directly radially outwardly of the crimp body.

In some embodiments, the sleeve is configured to extend over substantially the entire axial distance between an insulator of the electrical cable and an insulator around the conductive pin.

In some embodiments, the sleeve has a smooth outer profile.

In some embodiments, the sleeve has a radially outer surface and the crimp body has a radially outer surface. The diameter of the radially outer surface at the end of the sleeve corresponds to the diameter of the radially outer surface of the crimp body adjacent thereto.

In some embodiments, the crimp body includes a protrusion that an end of the conductive sleeve abuts against when the assembly is assembled.

In some embodiments, the assembly is an underwater electrical cable termination assembly.

An electrical cable termination includes an electrical cable termination assembly of a type described above; an electrical cable with a conductive core; and a conductive pin. The crimp body electrically connects the conductive core of the electrical cable to the conductive pin.

A method of terminating a cable includes terminating the cable with an assembly of a type described above.

The elements and features described above may be combined with each other in different combinations. For example, the features of the electrical cable termination assembly described above may be combined to form an assembly that includes a locking sleeve and/or a crimp body that extends axially, and/or a conductive sleeve. Such an assembly may include additional features as described above.

While the present invention has been described above by reference to various embodiments, it should be understood that many changes and modifications may be made to the described embodiments. It is therefore intended that the foregoing description be regarded as illustrative rather than limiting, and that it be understood that all equivalents and/or combinations of embodiments are intended to be included in this description.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding claim—whether independent or dependent—and that such new combinations are to be understood as forming a part of the present specification.

The invention claimed is:

1. An electrical cable termination assembly, comprising:

a crimp body configured for electrically connecting a conductive core of an electrical cable to a conductive pin, wherein the crimp body is further configured to receive the conductive core at a first end of the crimp body and the conductive pin at a second end of the crimp body;

a locking sleeve that is located radially outwardly of the crimp body, wherein the locking sleeve is movable relative to the crimp body between a locking position and an unlocking position, and wherein the locking sleeve is configured such that rotation of the locking sleeve moves the locking sleeve between the locking position and the unlocking position;

a locking member, wherein the locking member is movable relative to the crimp body so as to be able to lock the pin in the crimp body when the locking sleeve is moved from the unlocking position to the locking position, and wherein the locking member is at least partially disposed in an aperture in the crimp body when the locking sleeve is in the locking position;

a protrusion on the crimp body spaced axially from the second end; and a compensation insert at the second end of the crimp body, the compensation insert having a conical internal shape and a cylindrical outer shape such that the compensation insert at least partially extends over the locking sleeve when the locking sleeve is in the unlocking position, wherein the locking sleeve is threadedly engaged with the crimp body such that rotation of the locking sleeve causes the locking sleeve to move axially between the unlocking position and the locking position away from the second end until the locking sleeve abuts the protrusion, and wherein a distance between the locking sleeve and the second end is greater when the locking sleeve is in the locking position than when the locking sleeve is in the unlocking position.

2. The assembly of claim 1, wherein the locking sleeve comprises a recess, and wherein the locking member is at least partially located in the recess when the locking sleeve is in the unlocking position.

3. The assembly of claim 2, wherein the locking sleeve and the locking member are configured such that the locking member is moved out of the recess when the locking sleeve is moved from the unlocking position to the locking position.

4. The assembly of claim 1, wherein the locking member is moved in a radially inward direction when the locking sleeve is moved from the unlocking position to the locking position.

5. The assembly of claim 1, wherein the locking member comprises at least one ball.

6. The assembly of claim 1, wherein:

the assembly is configured to terminate an electrical cable with a conductive core and an axially extending annular insulation portion around the conductive core;

the crimp body is configured to be crimped to the conductive core of the electrical cable; and the crimp body comprises an axially extending part configured to extend axially forwardly along a length of the conductive core and to be located radially outwardly of the conductive core and radially inwardly of the annular insulation portion.

7. The assembly of claim 1, wherein the locking sleeve comprises a conductive sleeve;

wherein the conductive sleeve is electrically connected to the crimp body;

wherein the conductive sleeve is located radially outwardly of the crimp body;

wherein the conductive sleeve extends over at least part of the crimp body that receives the conductive core; and wherein the conductive sleeve extends over at least part of the crimp body that receives the conductive pin.

8. The assembly of claim 7, wherein the conductive sleeve extends over substantially an entire axial distance between an insulator of the electrical cable and an insulator around the conductive pin.

9. The assembly of claim 1, wherein the locking sleeve and the protrusion form a continuous external profile.

10. An electrical cable termination comprising:

a cable termination assembly;

an electrical cable with a conductive core; and a conductive pin, wherein the cable termination assembly comprises:

a crimp body configured for electrically connecting a conductive core of an electrical cable to the conductive pin, wherein the crimp body is further configured to receive the conductive core at a first end of the crimp body and the conductive pin at a second end of the crimp body;

a locking sleeve that is located radially outwardly of the crimp body, wherein the locking sleeve is movable relative to the crimp body between a locking position and an unlocking position, and wherein the locking sleeve is configured such that rotation of the locking sleeve moves the locking sleeve between the locking position and the unlocking position;

a locking member, wherein the locking member is movable relative to the crimp body so as to be able to lock the pin in the crimp body when the locking sleeve is moved from the unlocking position to the locking position, and wherein the locking member is at least partially disposed in an aperture in the crimp body when the locking sleeve is in the locking position;

a protrusion on the crimp body spaced axially from the second end; and a compensation insert at the second end of the crimp body, the compensation insert having a conical internal shape and a cylindrical outer shape such that the compensation insert at least partially extends over the locking sleeve when the locking sleeve is in the unlocking position, wherein the conductive core of the electrical cable is crimped in the crimp body at the first end thereof and the conductive pin is received in the crimp body at the second end thereof, wherein the pin is configured to be locked in the crimp body when the locking sleeve is in the locking position, and wherein the locking sleeve is threadedly engaged with the crimp body such that rotation of the locking sleeve causes the locking sleeve to move axially between the unlocking position and the locking position away from the second end until the locking sleeve abuts the protrusion, and wherein a distance between the locking sleeve and the second end is greater when the locking sleeve is in the locking position than when the locking sleeve is in the unlocking position.

11. The electrical cable termination of claim 10, wherein the pin comprises a circumferential groove, and wherein the locking member is configured to engage with the circumferential groove on the pin when the locking sleeve is in the locking position.

12. The electrical cable termination of claim 10, wherein the locking sleeve and the protrusion form a continuous external profile.

13. An electrical cable termination assembly for terminating an electrical cable with a conductive core and an axially extending annular insulation portion around the conductive core, the electrical cable termination assembly comprising:

a crimp body configured to be crimped to the conductive core of the electrical cable, wherein the crimp body comprises an axially extending part that is configured to extend axially forwardly along a length of the conductive core, and wherein the axially extending part is further configured to be located radially outwardly of the conductive core and radially inwardly of the annular insulation portion;

a locking sleeve that is located radially outwardly of the crimp body, wherein the locking sleeve is movable relative to the crimp body between a locking position and an unlocking position, and wherein the locking sleeve is configured such that rotation of the locking sleeve moves the locking sleeve between the locking position and the unlocking position;

a locking member;

a protrusion on the crimp body; and a compensation insert having a conical internal shape and a cylindrical outer share such that the compensation insert at least partially extends over the locking sleeve when the locking sleeve is in the unlocking position, wherein the locking member is movable relative to the crimp body when the locking sleeve is moved from the unlocking position to the locking position, wherein the locking member is at least partially disposed in an aperture in the crimp body when the locking sleeve is in the locking position, and wherein the locking sleeve is threadedly engaged with the crimp body such that rotation of the locking sleeve causes the locking sleeve to move axially between the unlocking position and the locking position until the locking sleeve abuts the protrusion, and wherein a distance between an end of the locking sleeve and the conductive core is greater when the locking sleeve is in the unlocking position than when the locking sleeve is in the locking position.

14. The electrical cable termination assembly of claim 13, wherein:

the crimp body comprises a crimp wall;

the axially extending part is formed by a front wall portion of the crimp wall;

the crimp wall comprises a wall portion axially rearwardly of the front wall; and the wall portion comprises a thickness that is greater than a thickness of the front wall portion.

15. The electrical cable termination assembly of claim 13, wherein the axially extending part comprises radial projections configured to contact a radially inner surface of the annular insulation portion.

16. The electrical cable termination assembly of claim 13, wherein the locking sleeve and the protrusion form a continuous external profile.

17. An electrical cable termination assembly comprising:

a crimp body configured for electrically connecting a conductive core of an electrical cable to a conductive pin, wherein the crimp body is further configured to receive the conductive core at a first end of the crimp body and the conductive pin at a second end of the crimp body;

a conductive sleeve that is electrically connected to the crimp body, wherein the conductive sleeve is located radially outwardly of the crimp body, wherein the conductive sleeve extends over at least part of the crimp body that receives the conductive core, wherein the conductive sleeve extends over at least part of the crimp body that receives the conductive pin, and wherein the conductive sleeve is movable relative to the crimp body between a locking position and an unlocking position and is configured such that rotation of the conductive sleeve moves the conductive sleeve between the locking position and the unlocking position;

a locking member;

a protrusion on the crimp body spaced axially from the second end; and a compensation insert at the second end of the crimp body, the compensation insert having a conical internal shape and a cylindrical outer shape such that the compensation insert at least partially extends over the conductive sleeve when the conductive sleeve is in the unlocking position, wherein the locking member is movable relative to the crimp body so as to be able to lock the pin in the crimp body when the conductive sleeve is moved from the unlocking position to the locking position, wherein the locking member is at least partially disposed in an aperture in the crimp body when the conductive sleeve is in the locking position, and wherein the conductive sleeve is threadedly engaged with the crimp body such that rotation of the conductive sleeve causes the conductive sleeve to move axially between the unlocking position and the locking position away from the second end until the conductive sleeve abuts the protrusion, and wherein a distance between the conductive sleeve and the second end is greater when the conductive sleeve is in the locking position than when the conductive sleeve is in the unlocking position.

18. The assembly of claim 17, wherein the conductive sleeve is configured to extend over substantially an entire axial distance between an insulator of the electrical cable and an insulator around the conductive pin.

19. The assembly of claim 17, wherein the conductive sleeve comprises a smooth outer profile.

20. The assembly of claim 17, wherein the locking sleeve and the protrusion form a continuous external profile.

* * * * *